US007854894B2

(12) United States Patent
Bittner et al.

(10) Patent No.: US 7,854,894 B2
(45) Date of Patent: Dec. 21, 2010

(54) FEED DEVICE FOR LIQUID SAMPLES

(75) Inventors: Klaus Bittner, Krefeld (DE); Michael Kussmann, Duesseldorf (DE)

(73) Assignee: Hach Lange GmbH, Berlin (DE)

( * ) Notice: Subject to any disclaimer, the term of this patent is extended or adjusted under 35 U.S.C. 154(b) by 1422 days.

(21) Appl. No.: 11/194,022

(22) Filed: Jul. 29, 2005

(65) Prior Publication Data

US 2006/0024210 A1 Feb. 2, 2006

(30) Foreign Application Priority Data

Jul. 31, 2004 (EP) ..... 04018193

(51) Int. Cl.
*B01L 3/02* (2006.01)

(52) U.S. Cl. ..... 422/100; 422/73; 422/74; 422/99; 436/180

(58) Field of Classification Search ..... 422/73–74, 422/99–100; 436/180
See application file for complete search history.

(56) References Cited

U.S. PATENT DOCUMENTS 3,851,342 A 12/1974 Moore ..... 4/256
4,008,008 A * 2/1977 Vergnet ..... 417/385
4,616,982 A * 10/1986 Quarve ..... 417/383
5,307,697 A * 5/1994 Davis et al. ..... 73/864.81
6,085,837 A * 7/2000 Massinon et al. ..... 166/265
6,541,272 B1 * 4/2003 Mitra ..... 436/178
6,585,675 B1 * 7/2003 O'Mahony et al. ..... 604/4.01
2003/0123997 A1 * 7/2003 Hauser ..... 417/251

FOREIGN PATENT DOCUMENTS

DE 100 21 454 C2 11/2001

* cited by examiner

*Primary Examiner*—Jyoti Nagpaul
(74) *Attorney, Agent, or Firm*—Fay Sharpe LLP

(57) ABSTRACT

Feed devices for liquid samples serve to convey liquid samples, for example to convey a liquid sample from waste water in a waste water treatment plant so as to monitor the treatment process. Known feed devices feed continuously at relatively low speeds. Films may accrete in the feed line that hinder the feeding and may react with the liquid sample. Therefore, the feed line must be cleaned frequently. In view of this, it is the object of the invention to improve the handling and the maintenance of a feed device for liquid samples. According to the invention, this object is solved by the fact that the feed pump (16) feeds in a pulse-like manner and the feed pump (16) as well as the feed line (18) are configured such that the expansion volume of the feed line (18) during the feed pulse is at most 50% of the pulse volume. Thereby, the feed line is cleaned and kept free of accretions.

1 Claim, 1 Drawing Sheet

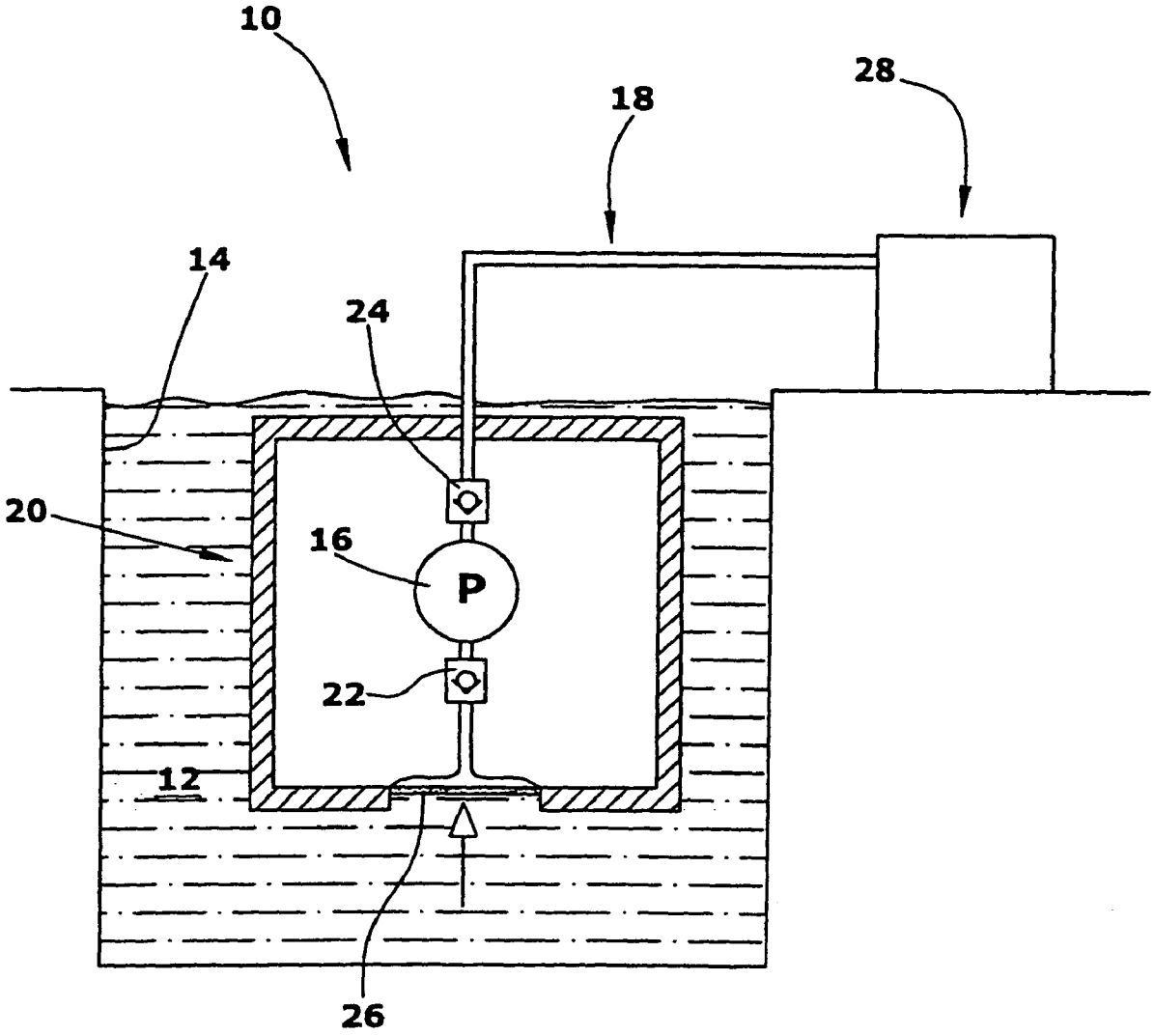
10
28
18
14
24
20
16
P
22
12
26

FEED DEVICE FOR LIQUID SAMPLES

The invention refers to a feed device for liquid samples comprising a feed pump and a feed line.

Feed devices for liquid samples comprise a feed pump and a feed line and are employed, for example, in online analytics, sampling, collecting samples, and for feeding liquid samples from waste water to an analyzing apparatus remote from the sampling site. Such arrangements are used, for example, in waste water treatment plants to monitor the waste water and the treatment process, respectively. Although the liquid samples in waste water treatment plants are generally already almost free of solid matter, they still contain nutrients. The nutrients allow for the growth of bacteria. Thereby, a bacterial film may form in the feed line in which the liquid sample is continually conveyed, where other dissolved components, e.g. iron trichloride and fats, may also settle and solidify in the film which may cause a complete obstruction of the feed line. Further, the bacterial film can influence a sample flowing through the feed line, e.g. by decomposition of ammonium through nitrification, so that the determination of waste water parameters subsequently made in the analyzing apparatus will be corrupted. To avoid this, frequent cleaning and maintenance of the feed line are necessary.

It is the object of the present invention to provide a liquid sample feed device wherein the feed line requires less maintenance and cleaning.

According to the invention, the object is achieved with the features of claim 1.

In the present feed device, the feed pump feeds in a pulse-like manner, and the feed line and the feed pump are configured such that the expansion volume of the feed line during the feed pulse is at most 50% of the pulse volume. The feed pump thus no longer feeds the liquid sample continually, but substantially in a pulse-like manner. Thereby, the liquid sample is accelerated to a relatively high flow velocity during the pulse, so that the liquid loosens films from the inner wall of the feed line and takes them along. A corresponding configuration of the feed pump and the feed line ensures that the liquid reaches velocities of 0.5 m/s to 4 m/s in the feed line during a feed pulse. The kinetic energy thus introduced is in large parts converted into turbulences and friction in the border layer adjacent the inner side of the feed line, whereby the film is reliably removed already when it is in the making. No cleaning and maintenance of the feed line and possibly of the feed pump are required any longer.

During the feed pulse, the expansion volume of the feed line is at most 50% of the pulse volume, i.e. the volume by which the feed line expands during the feed pulse is at most 50% of the total volume of the liquid volume conveyed by a pulse. It should be noted that this always refers to a feed line having a length of several meters for typical applications. The less the feed line expands, i.e. enlarges, during the feed pulse, the less the feed pulse is flattened or the higher the velocity of the liquid in the feed line remains during the feed pulse over the entire length of the feed line. The higher the velocity of the liquid during the feed pulse, the better the cleaning effect.

Preferably, the feed pump is configured such that the ratio of the pulse pressure to the feed line length is at least 0.5 bar/m, the pulse pressure being the maximum pressure during the feed pulse. The longer the feed line, the higher the pressure must be with which the feed pulse is introduced into the feed line. A ratio of at least 0.5 bar/m ensures that a high velocity of the liquid prevails in the feed line during the pressure pulse along the entire length of the feed line, i.e. also at the end opposite the pump.

Preferably, the feed pump is arranged in a waste water dip tank that serves the sampling and possibly the preparation of samples and from which liquid samples are pumped through the feed line to an analyzing apparatus that may be set up at the edge of a waste water basin, for example. The feed pump may be designed as a membrane pump that operates as a pressure pump with respect to the feed line. The membrane pump draws a liquid sample and then presses the same into the feed line in a pulse-like manner.

According to a preferred embodiment, the feed pump and the feed line are configured such that, during the feed pulse, the expansion volume of the feed line is at most 30%, in particular at most 10% of the pulse volume. This ensures that only a relatively small part of the feed pulse is flattened by the expansion of the feed line during the feed pulse. This, in turn, allows for the use of a comparatively small feed pump and guarantees a relatively low energy consumption necessary for the feeding.

Preferably, the pulse duration of the feed pulse is shorter than 100 ms. The pulse duration is the duration of the entire feed pulse, i.e. from the start of the feed motion to the end of the feed motion of the pump.

Generally, the feed pulses may be superimposed on a continual feed of the liquid. Preferably, however, it is provided that the feed pump does not feed between the feed pulses, i.e. the liquid samples are fed exclusively during the feed pulses. In this manner, the largest differential pressure, and thus differential velocity, possible between pulse and non-pulse is realized. This in turn ensures the highest cleaning effect possible.

In a preferred embodiment, the feed line is made at least on its inner side of a material with low surface energy. With such a material, the adhesion forces of bacteria and other accretions are relatively low so that it is ensured that accretions are loosened and taken along during and by the feed pulse.

The feed line may be made from a smooth-surface fluoropolymer, e.g. FEP.

The following is a detailed description of an embodiment of the present invention with reference to the drawing.

The FIGURE illustrates a feed device for liquid samples according to the invention.

DETAILED DESCRIPTION OF THE PREFERRED EMBODIMENT OF THE INVENTION

The FIGURE illustrates a feed device 10 for liquid samples serving to draw a liquid sample from a waste water basin 14 containing waste water 12. the feed device 10 is substantially formed by a feed pump 16 and a feed line 18. the feed pump 16 is a membrane pump operated as a pressure pump with respect to the feed line 18 and is arranged in a liquid-tight dip container 20. The feed pump 16 is associated to an inlet valve 22 and an outlet valve 24 positioned downstream and upstream of the feed pump 16, respectively. The feed pump 16 draws filtered liquid from the waste water 12 through a filter membrane 26 and then pumps the same through the feed line 18 to an analyzing device arranged outside the waste water basin 14.

The feed line 18 has a length of 10 m and an inner diameter of about 1.0 mm. The wall of the feed line 18 is made from FEP, the inner surface being made smooth. FEP is a fluoropolymer with low surface energy so that films adhere with relatively low adhesive force.

The feed pump 16 feeds the liquid exclusively in a pulse-like manner. The pressure of a feed pulse is at least 5.0 bar.

The pulse duration is less than 100 ms. The feed frequency is 1.0 Hz. No liquid feeding is performed between the feed pulses.

The feed line 16 is resistant to pressure such that its expansion volume during a feed pulse is 10% at most.

With the adjustment described above, velocities of the liquid in the feed line 18 of about 1.0 m/s are obtained in one feed pulse. The kinetic energy introduced thereby is in large parts converted into turbulences and friction in the border layer adjacent the inner side of the feed line. Films and accretions are reliably removed thereby.

Since the feed pulses are introduced in relatively short time intervals, the films practically have no time to adhere. As soon as an accretion becomes larger, it offers enough attacking surface to be reliably broken off from the feed line inner wall by a feed pulse and to be carried away by the liquid.

What is claimed is:

1. A method of liquid sampling with the feed pump and feed line the method comprising:

extending the feed line from a liquid sample inlet to a sample analysis device, the feed line having an inner diameter of less than 10 mm;

with the feed pump disposed in a waste water drip tank that serves as a source of liquid samples, pumping the liquid samples through the feed line in feed pulses which expand a volume of the feed line by less than 50% of a volume of the feed pulse;

wherein the liquid sample is pumped in a liquid state through the feed line;

wherein liquid samples tend to deposit films on an interior surface of the feed line;

wherein during feed pulses, the liquid samples reach velocities of at least 0.5 m/s and the feed line is a plurality of meters in length; and further including maintaining the feed velocity during at least a peak of each feed pulse such that the feed velocity of the sample liquid during the peak of the feed pulse removes film from the interior surface of the feed line reducing cleaning and maintenance of the feed line.

* * * * *